US005919337A

United States Patent [19]

Olsson et al.

[11] Patent Number: 5,919,337

[45] **Date of Patent: *Jul. 6, 1999**

[54] METHOD OF CONTINUOUSLY ISOTHERMALLY COOKING OF PULP

[75] Inventors: Sven-Erik Olsson, Kil; Stig Andtbacka, Högbackagatan, both of Sweden; Finn Jacobsen, Maltvägen, Norway; Åke Backlund, Herrgårdsgatan; Johanna Svanberg, Karlagatan, both of Sweden

[73] Assignee: Kvaerner Pulping Technologies AB, Karlstad, Sweden

[ * ] Notice: This patent is subject to a terminal disclaimer.

[21] Appl. No.: 08/436,341

[22] PCT Filed: Nov. 16, 1993

[86] PCT No.: PCT/SE93/00978

§ 371 Date: Jul. 27, 1995

§ 102(e) Date: Jul. 27, 1995

[87] PCT Pub. No.: WO94/11567

PCT Pub. Date: May 26, 1994

[30] Foreign Application Priority Data

Nov. 18, 1992 [SE] Sweden ..... 9203462
Apr. 20, 1993 [SE] Sweden ..... 9301284

[51] Int. Cl.[6] ..... D21C 3/24

[52] U.S. Cl. ..... 162/17; 162/60; 162/237

[58] Field of Search ..... 162/17, 19, 42, 162/60, 237

[56] References Cited

U.S. PATENT DOCUMENTS

| | | | |
|---|---|---|---|
| 4,123,318 | 10/1978 | Sherman | 162/19 |
| 5,066,362 | 11/1991 | Meredith | 162/17 |
| 5,236,554 | 8/1993 | Greenwood | 162/238 |
| 5,328,564 | 7/1994 | Jiang et al. | 162/38 |

FOREIGN PATENT DOCUMENTS

| | | |
|---|---|---|
| 0 476 230 | 3/1992 | European Pat. Off. . |
| 211 196 | 2/1967 | Sweden . |

OTHER PUBLICATIONS

Backlund, E.A., "Extended Delignification . . . Continuous Digester", Tappi Journal, Nov. 1984.

*Primary Examiner*—Dean T. Nguyen
*Attorney, Agent, or Firm*—Seed and Berry LLP

[57] ABSTRACT

The present invention relates to a digester for continuous cooking, under elevated pressure and temperature, of fibre material in a vertical digester (1), where fibre material and cooking liquid are fed into the top of the digester, used cooking liquor is drawn off from at least one digester screen arrangement (1D) between the top and the bottom of the digester, and fibre material is fed out from the bottom of the digester, it being possible to maintain the temperature in the cooking zone immediately above the digester screen arrangement (1B) at essentially the same temperature level as the remaining cooking zone or cooking zones of the digester.

17 Claims, 3 Drawing Sheets

METHOD OF CONTINUOUSLY ISOTHERMALLY COOKING OF PULP

BACKGROUND OF THE INVENTION

The environmental authorities are placing ever more stringent demands on the pulp industry to decrease the use of chemicals which can be harmful to the environment, such as chlorine, for example. Thus, permitted discharges of organic chlorine compounds in the effluent water from bleaching plants and the subsequent cooking process have been successively decreased and are now at such a low level that pulp works have in many cases stopped using organic chlorine compounds as bleaching agents. In addition, market forces are tending successively to increase the demand for paper products which have not been bleached with chlorine.

The pulp industry is therefore seeking methods which permit bleaching of pulp without using these chemicals. As an example of such a method, the lignox method (see SE-A 8902058) can be mentioned, in which, inter alia, bleaching is carried out with hydrogen peroxide. Ozone is another bleaching chemical of interest which is also being used to an increasing extent. It is thus possible, using such bleaching chemicals, to achieve the brightnesses which are demanded for marketed pulp, i.e. 89 ISO and higher, without using chlorine-containing bleaching agents.

However, there is a problem in employing these bleaching chemicals which do not contain chlorine in currently known bleaching processes, namely that these chemicals impair to a relatively large extent the quality of the pulp fibers.

DESCRIPTION OF THE INVENTION

With the aid of experiments which have been conducted under the auspices of Kamyr AB, it has emerged, in a surprising manner, that extremely good results with regard to delignification and strength properties can be achieved if the pulp is cooked at the same temperature level throughout essentially the whole digester, i.e. if essentially the same temperature is maintained in all the cooking zones and a certain quantity of alkali is also added to the lowest zone of the digester, which zone is normally used for washing in countercurrent owing to the fact that essentially the same temperature level is maintained in virtually the whole digester, very extensive delignification can be obtained at a relatively low temperature. In addition, it has emerged that the strength properties are affected in a particularly advantageous manner, that a higher yield of fibre raw material is obtained and that the reject quantity is decreased. These advantages are most clearly evident from the diagrams shown in FIGS. 1 and 2, which diagrams show comparative values between pulp (softwood) which was cooked by the modified conventional cooking technique and pulp which was cooked in accordance with the process according to the invention (in a similar digester, i.e. having a cocurrent upper cooking zone, a middle countercurrent cooking zone and a bottom countercurrent washing zone), in which a constant temperature level of about +155° C. was maintained in the whole digester.

The invention relates to an arrangement, which is advantageous from the point of view of equipment, for effecting a cooking in accordance with the new method, in particular with regard to digesters built according to an older principle, and consisting of an upper cocurrent cooking zone and a lower countercurrent washing zone. Thus, certain practical problems ensue as a consequence of an isothermal cooking process. A first such problem is the difficulty of efficiently reaching and maintaining the temperature in the lower part of the digester, i.e. that part which is normally utilized for washing.

A related problem is that, in order to be able to maintain the high temperature in the digester in the preferred case, the pulp must be taken out of the digester at a temperature exceeding +100° C., implying that, if a blowing off to atmospheric pressure were to take place, a disintegration of an explosive nature would be obtained in direct connection with this, with consequent negative effect on the pulp quality.

In order to avoid the said strength-diminishing disintegration of the cooked pulp, it is proposed, in accordance with the invention, that a pressurized washing apparatus be connected directly after the digester and that the pulp be conducted to this washing apparatus without any real diminution in pressure taking place. Moderate lowering of the pressure does not take place until after the pressurized wash, when the temperature and alkali content of the pulp have been lowered to a level such that the lowering of pressure consequently has little or no negative effect on the quality of the pulp. A washing apparatus of this type can advantageously comprise a pressure diffuser, in which case the advantage is also gained that the hot and pressurized draw-off from this pressure diffuser can be used as washing liquid in the high-heat zone. This provides significantly increased heat economy while at the same time resulting in reduced pumping energy and decreasing the need for heat exchangers of cumbersome size.

DETAILED DESCRIPTION

Figures 1A, 1B, 1C:
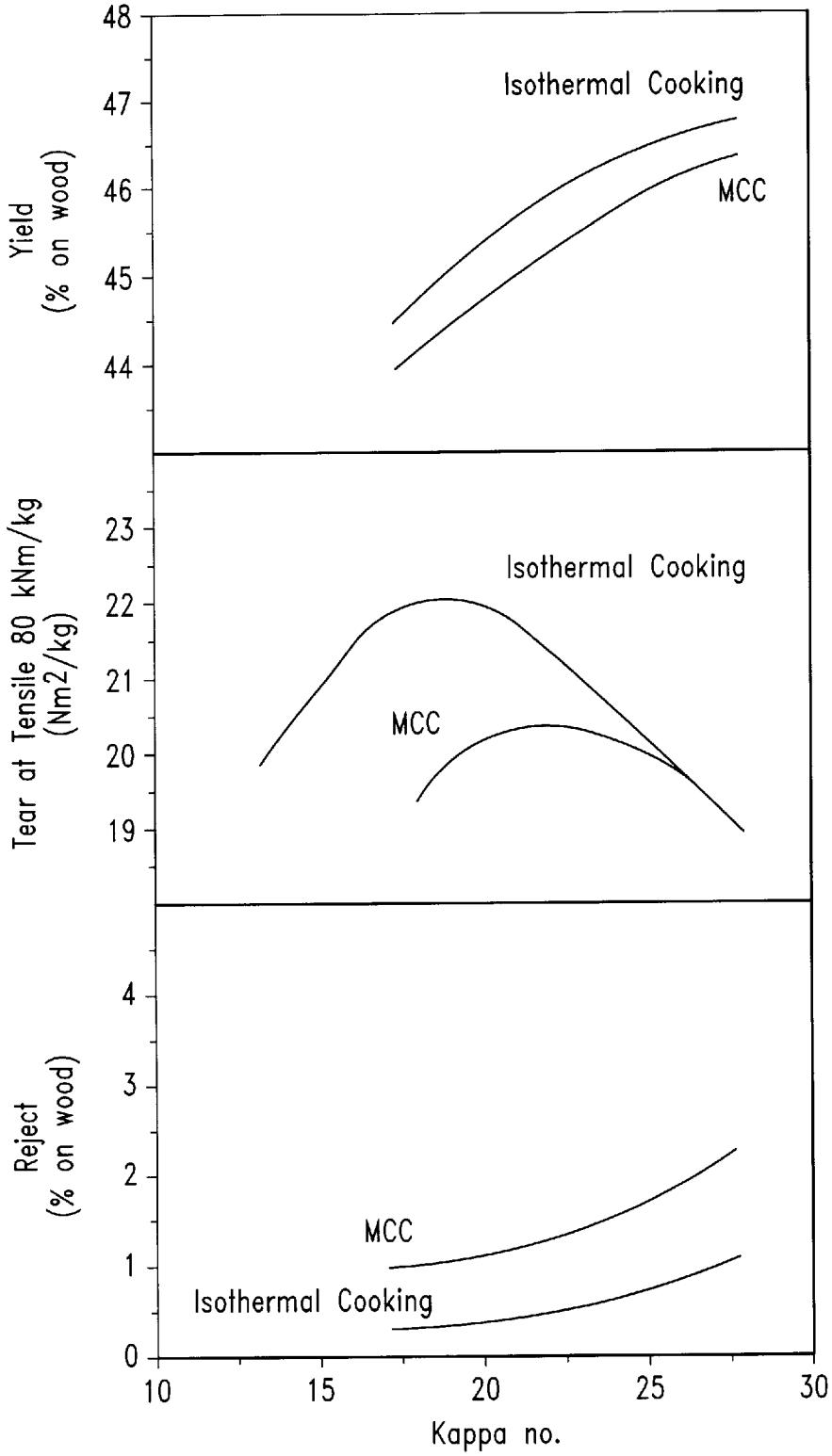
In FIGS. 1A, 1B and 1C, isothermal cooking and so-called modified conventional cooking (MCC) are compared in three diagrams.
Figure 2:
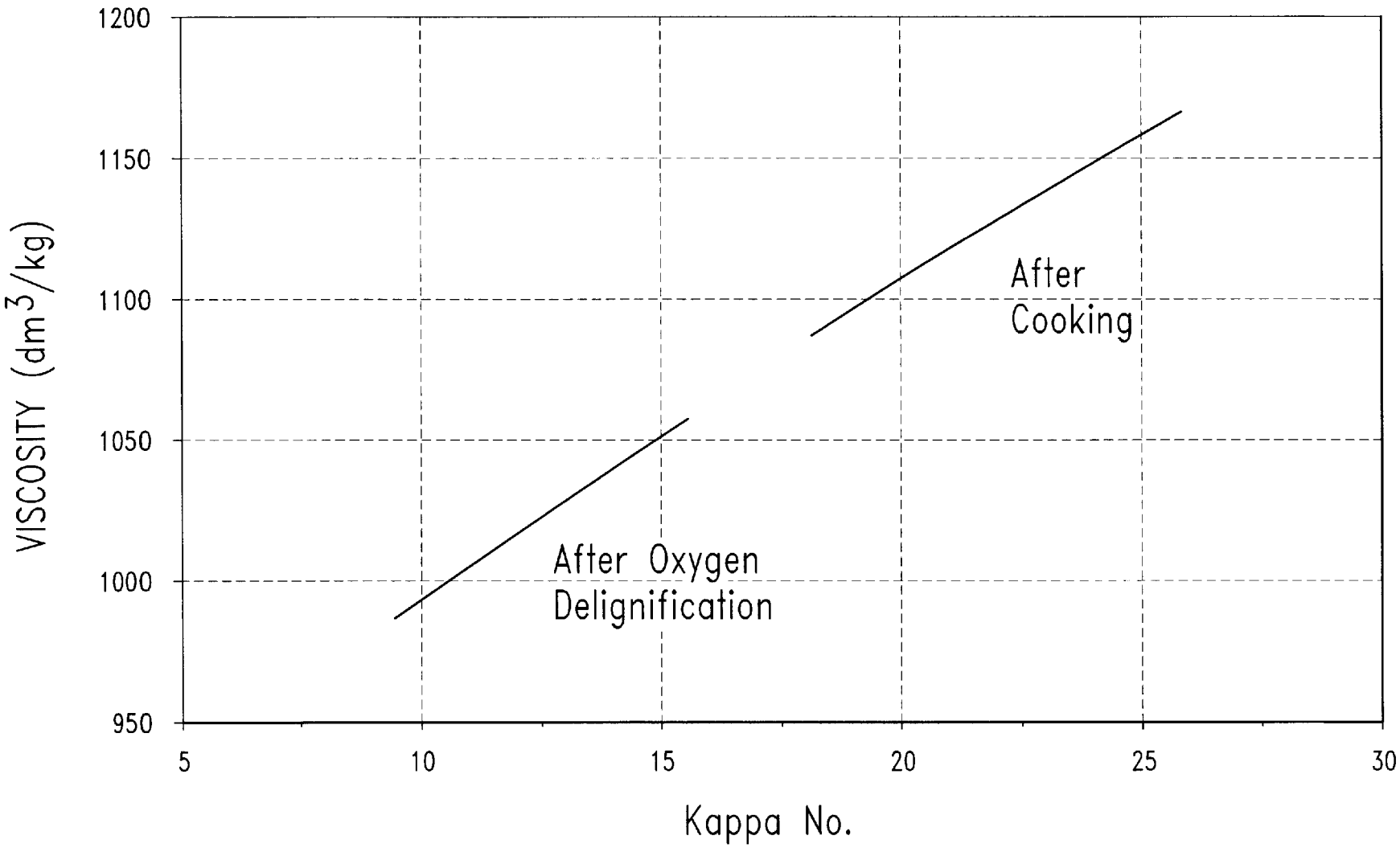
FIG. 2 shows a diagram which describes the degree of delignification and the viscosity (the viscosity is normally considered to indicate the strength properties of the pulp)

FIGS. 1A, 1B and 1C show three diagrams which compare different results obtained in association with isothermal cooking and modified conventional cooking (MCC). These surprisingly positive results demonstrate that, according to the upper diagram, a significantly lower kappa number is obtained, for a given level of yield (which depends, inter alia, on the quantity of alkali employed), when isothermal cooking is used. Furthermore, the second diagram shows that markedly better strength properties are obtained when cooking down to the same kappa number. In addition to this, the third diagram shows that the advantage is also gained that the quantity of wasted wood (the content of shives) is decreased. If to this is added the fact that, taken overall, substantial savings in energy are made in association with maintaining the temperature level constant, it will be understood that the results can be perceived as being surprisingly positive. In addition, FIG. 2 demonstrates that the method according to the invention makes it possible to reach very low kappa numbers, while retaining good pulp strength (viscosity of about 1000), after oxygen delignification. Thus, when the method according to the invention is used, so-called environmentally-friendly bleaching chemicals, such as peroxide and ozone, can be employed in subsequent bleaching stages without the risk of the strength being too low to permit bleaching up to the brightness level, and consequently also the purity level, demanded by the market.

Figure 3:
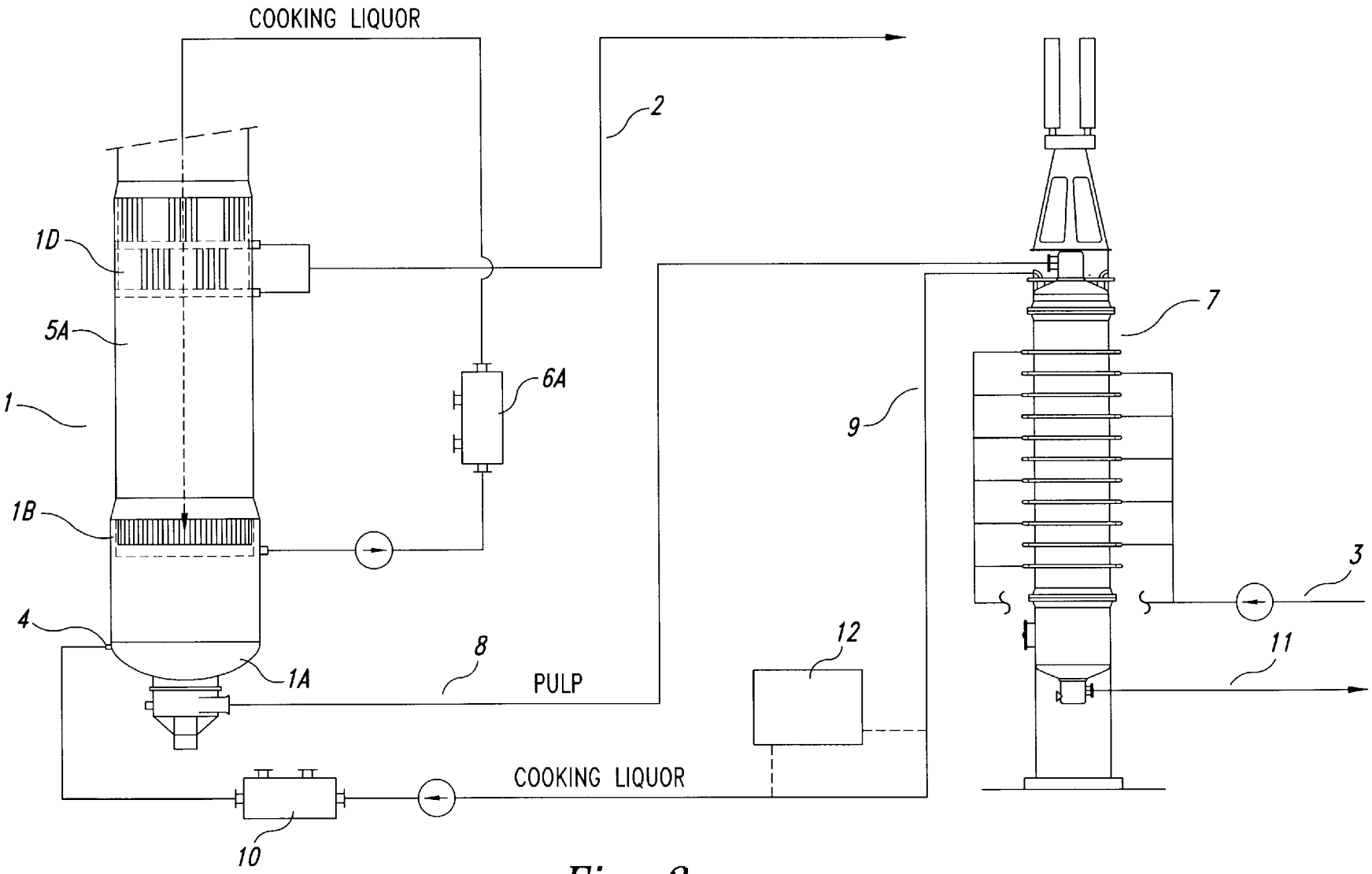
FIG. 3 shows how, in a preferred manner using a pressure diffuser, an existing digester can be converted so that it can be operated in accordance with the novel process.

FIG. 3 shows the lower part of a digester 1, which is intended to symbolize an existing digester shell. The digester is of the type which has an upper cocurrent part and a lower countercurrent part. In such a digester, full cooking temperature (i.e. about 162° C. for hardwood and about 168° C. for softwood) is normally maintained in the cocurrent zone, while, in the countercurrent part, which is principally a washing zone, the temperature is normally about 135° C. on a level with and above the lower screen.

In that which follows, the countercurrent zone of the digester will be referred to as a cooking zone even if it is to be considered, in accordance with conventional operation, as a washing zone.

Liquid is supplied to the lower part of the digester through an inflow arrangement 4 mounted in the vicinity of the bottom 1A of the digester. This liquid consists, in the first instance, of washing liquid from a washing apparatus in a later stage. In addition, the liquid can contain fresh alkali (white liquor), which is added here in this loop and/or in the draw-off from the lower screen cincture (1B). The cooked pulp is collected via a conduit from the bottom of the digester.

A central pipe 5A is fed from the lower screen arrangement 1B of the digester via a first heat exchanger 6A. The central pipe opens out on a level with the latter screen arrangement in the digester. The cooking liquid thereafter flows in a countercurrent manner up towards the draw-off screens 1D. The draw-off from this middle screen arrangement 1D of the digester is taken off via a conduit 2 for further treatment.

FIG. 3 additionally shows that, in accordance with a preferred embodiment, a pressure diffuser 7 has been arranged alongside the digester 1. The pulp which is fed out from the bottom of the digester is conducted via conduit 8, without any real fall in pressure (preferably less than 1 bar, for example about 0.5 bar) to the said pressure diffuser 7. This implies that the pressure in the pressure diffuser will correspond to that in the digester, i.e. somewhere between 10 and 20 bar in the bottom region. The liquid which is drawn off from the pressure diffuser is led back to the digester 1 via a conduit 9. In certain cases, it is advantageous, in this connection, to make use of a relatively small heat exchanger 10 to provide additional heat to this liquid, which is added to the bottom of the digester. The washing liquid 3 (expediently obtained from subsequent stages), which is fed into the pressure diffuser 7, should have a temperature which is well below +100° C. in order to be able to obtain a pulp from the pressure diffuser 7, in conduit 11, which has a temperature below +100° C. (expediently at a consistency of about 10%) in order thereafter to be able to cold blow the pulp, thereby ensuring that the pulp retains its high quality.

In order to be able to maintain an advantageous heat and liquid balance, the pulp leaving the digester should have a temperature exceeding +100° C., expediently a temperature of between +105° C. and +115° C. It is furthermore desirable that about a third of the heating requirement comes about in the lower zone of the digester (the so-called high-heat zone). In this connection, the liquid 9, which is drawn off from the pressure diffuser, will have a temperature of about +100° C. or somewhat higher, depending on the exact temperature flow prevailing. If necessary, therefore, this liquid should be heated somewhat in a heat exchanger 10 in order to ensure that its temperature is at the optimum, preferably +100° C.–+110° C., before it is supplied to the lower part of the digester. The liquid which, in this connection, is drawn off through the lower screen assembly 1B of the digester is conveyed, via a central pipe 5A, back to the digester 1. In connection with this liquid being returned, it is heated in a heat exchanger 6A so that the digester is maintained at essentially the same temperature level in all three zones. In the preferred case, the temperature of the chip column does not differ by more than 2° C. between that part which is located at the upper end of the lower screen assembly 1B and that part which is located in the highest cooking zone. In an embodiment which is even more preferred, it does not differ by more than 1° C. between these two levels. As has already been mentioned, +155° C. (chiefly for hardwood) is a preferred temperature level, but other temperatures between +150° C. and +165° C. are also possible, even if, inter alia for reasons of heat economy, temperatures of below +160° C. are to be preferred.

In the case described, washing liquid at 70° is supplied to the pressure diffuser. Advantageously, a buffer 12 can be used between the pressure diffuser 7 and the digester 1 for the draw-off from the respective washing liquids to these two units. Accordingly, a buffer 12 of this type must be pressurized.

In accordance with an alternative process, a further vessel, for example a tower of the type which is used for storing pulp, in which vessel a further delignification takes place, can be arranged between the digester and the pressure diffuser. According to this alternative process, a pressure-regulating device is expediently arranged prior to this second delignification vessel, with the aid of which device a suitable pressure drop is controlled, principally with a view to regulating the feeding of the pulp in an optimal manner. Further alkali is preferably added directly after such a pressure-regulating device. In addition, some form of influx and mixing device (for example an MC mixer) is expediently arranged in connection with the latter alkali addition, so that the newly added cooking liquid is thoroughly distributed in the pulp. In accordance with this alternative process for carrying out the invention, the pressure drop through the pressure-regulating device should be at least about 3 bar. By contrast, the pressure drop from this second vessel to the pressurized washing apparatus should be as small as possible, i.e. preferably less than 1 bar.

The invention is not limited by that which has been shown above, but can be varied within the scope of the subsequent patent claims. Thus, an existing digester of the MCC type can also be arranged in accordance with the invention, where, therefore, the digester has a top cocurrent part, a middle, principally countercurrent, part, and a bottom countercurrent part, with a part of the cooking liquid being added to the said bottom countercurrent part, the so-called high-heat zone. A digester of the so-called hydraulic type, having a lower temperature in the top part (the impregnation zone), can also advantageously be arranged in accordance with the invention for cooking in a so-called isothermal manner in accordance with the invention. In addition, the method can be used in conjunction with all types of cooking liquid, even if the method is principally intended for producing sulphate pulp. In addition to this, it is obvious to the person skilled in the art that the invention is not limited to the exemplifying temperature levels given above; however, in this context, it applies that the average temperature level in the digester should preferably exceed +150° C. but be less than +165° C., and preferably be between 150–155° C. for hardwood and between 160–165° C. for softwood, and, additionally, that the mean temperature in the cooking zone/zones should preferably be about +151° C. ±1° C., when the wood is hardwood, and, respectively, that the mean temperature in the digester should be +159° C. ±1° C., when the wood is softwood. Finally, it is pointed out that new digesters can also, naturally, be arranged with screen arrangements and procedural steps in accordance with the invention.

We claim:

1. A method wherein fiber material is continuously cooked to produce pulp of low kappa number, good pulp strength and suitable for bleaching without using chlorine-containing bleaching agents, comprising the steps:

(a) providing a vertical digester having a top, a bottom, at least one digester screen arrangement located between the top and the bottom of the digester, a digester screen arrangement located nearest the bottom of the digester, and at least two cooking zones, wherein one of the at least two cooking zones is located directly above the lowest digester screen arrangement;

(b) feeding fiber material and cooking liquid into the top of the vertical digester;

(c) maintaining elevated temperature and pressure within the vertical digester;

(d) maintaining isothermal conditions within and between the at least two cooking zones;

(e) withdrawing used cooking liquor from at least one digester screen arrangement located between the top and bottom of the digester;

(f) discharging pulp directly from the bottom of the digester, through a first conduit and into a pressurized washing apparatus while maintaining essentially the same pressure within the first conduit as is present in the bottom of the digester; and (g) bleaching the pulp after pressurized washing step (f).

2. The method of claim 1 wherein the bleaching is accomplished without the use of chlorine-containing bleaching agents.

3. The method of claim 1 wherein the pressurized washing apparatus comprises a pressure diffuser.

4. The method of claim 3 wherein a draw-off from the pressure diffuser is supplied, via a second conduit, to the bottom of the digester, and liquid supplied to the digester in the draw-off has a temperature exceeding 100° C.;

the pulp discharged from the digester has a temperature of 105° C. to 115° C.;

liquid at a temperature which is less than 100° C. is supplied to the pressure diffuser; and pulp at a temperature of less than 100° C. is collected from the pressure diffuser.

5. The method of claim 4 wherein the liquid in the draw-off has a temperature not exceeding 110° C.;

the pulp discharged from the digester has a temperature of about 110° C.; and the liquid supplied to the-pressure diffuser has a temperature of 75° C. ±5° C.

6. The method of claim 4 wherein a heating device provides heat to the liquid in the second conduit, and a buffer device is positioned between the pressure diffuser and the vertical digester.

7. The method of claim 6 wherein the buffer device is pressurized.

8. The method of claim 1 wherein the elevated temperature is in excess of 150° C. and less than 165° C.

9. The method of claim 8 wherein the elevated temperature is between 150° C. and 155° C. when the fiber material is hardwood fiber and between 160° C. and 165° C. when the fiber material is softwood fiber.

10. The method of claim 8 wherein the temperatures of the cooking zones deviate by at most ±1° C.

11. The method of claim 1 wherein the pressurized washing apparatus can tolerate a pressure exceeding 8 bar.

12. The method of claim 1 wherein the pressurized washing apparatus can tolerate a pressure exceeding 12 bar.

13. The method of claim 1 wherein the pressured washing apparatus can tolerate a pressure exceeding 15 bar.

14. The method of claim 1 wherein the first conduit has been retrofitted to an existing vertical digester.

15. The method of claim 1 wherein the cooking liquid of step (b) is added to the vertical digester through an inflow arrangement mounted in the vicinity of the bottom of the vertical digester.

16. The method of claim 1 wherein the cooking liquid of step (b) is added to the vertical digester through a draw-off from a lower screen cincture.

17. The method of claim 1 wherein the temperature of the cooking zones deviate by at most ±1° C.

* * * * *